United States Patent [19]

Dehaese

[11] Patent Number: 5,033,130

[45] Date of Patent: Jul. 23, 1991

[54] PROTECTION ARTICLE FOR DEJECTA RECEIVERS

[75] Inventor: Brigitte Dehaese, Brussels, Belgium

[73] Assignee: Patents Exploitation Company B.V., Rotterdam, Netherlands

[21] Appl. No.: 440,028

[22] Filed: Nov. 21, 1989

Related U.S. Application Data

[63] Continuation of Ser. No. 201,472, Jun. 1, 1988, abandoned.

[51] Int. Cl.[5] ..... A61G 9/00

[52] U.S. Cl. ..... 4/452

[58] Field of Search ..... 4/450–457, 4/484

[56] References Cited

U.S. PATENT DOCUMENTS

| | | | |
|---|---|---|---|
| 2,242,088 | 5/1941 | Rainboth | 4/456 |
| 2,320,845 | 6/1943 | Bolton | 4/452 |
| 2,910,705 | 11/1959 | Coplan | 4/242 |
| 3,005,994 | 10/1961 | Heil | 4/484 |
| 3,194,185 | 7/1965 | Spinosa | 383/36 X |
| 3,381,315 | 5/1968 | Glassberg | 4/484 |
| 3,383,712 | 5/1968 | Grant | 4/452 |
| 3,475,767 | 11/1969 | Friesen et al. | 4/452 |
| 3,546,716 | 12/1970 | Laumann | 4/452 |
| 3,579,655 | 5/1971 | Sunberg | 4/484 X |
| 3,591,870 | 7/1971 | Friesen et al. | 4/452 |
| 3,605,127 | 9/1971 | Dailey | 4/484 X |
| 3,906,555 | 9/1975 | Scott et al. | 4/452 |
| 3,936,890 | 2/1976 | Oberstein | 4/452 |
| 4,136,798 | 1/1979 | Oberstein | 4/452 |
| 4,509,215 | 4/1985 | Paz | 4/452 |

FOREIGN PATENT DOCUMENTS

| | | | |
|---|---|---|---|
| 0296143 | 12/1988 | European Pat. Off. . | |
| 2906560 | 8/1980 | Fed. Rep. of Germany | 4/452 |
| 2196246 | 4/1988 | United Kingdom . | |

*Primary Examiner*—Charles E. Phillips

*Attorney, Agent, or Firm*—Christie, Parker & Hale

[57] ABSTRACT

A protective cover for bedpans or the like comprises two sheets of paper, each waterproofed on one face with polyethylene. The sheets are superimposed one upon the other, waterproofed sides together, and the edges of the sheets are bonded together along a major portion of their perimeter. The unbonded portion of the perimeter of the sheets is of a size sufficient to extend over the edges surrounding the opening of a bedpan or the like. Elasticized thread is stitched to the edges of the unbonded portion of the perimeter for fitting and securing the cover over the external walls of the receiver and temporarily securing the sheets against motion with respect to the bedpan. A band of pressure sensitive adhesive is affixed to at least one sheet adjacent to the unbonded portion of the perimeter of the sheet for sealing the sheets together after use, thereby confining and retaining the dejecta within the protective cover.

11 Claims, 2 Drawing Sheets

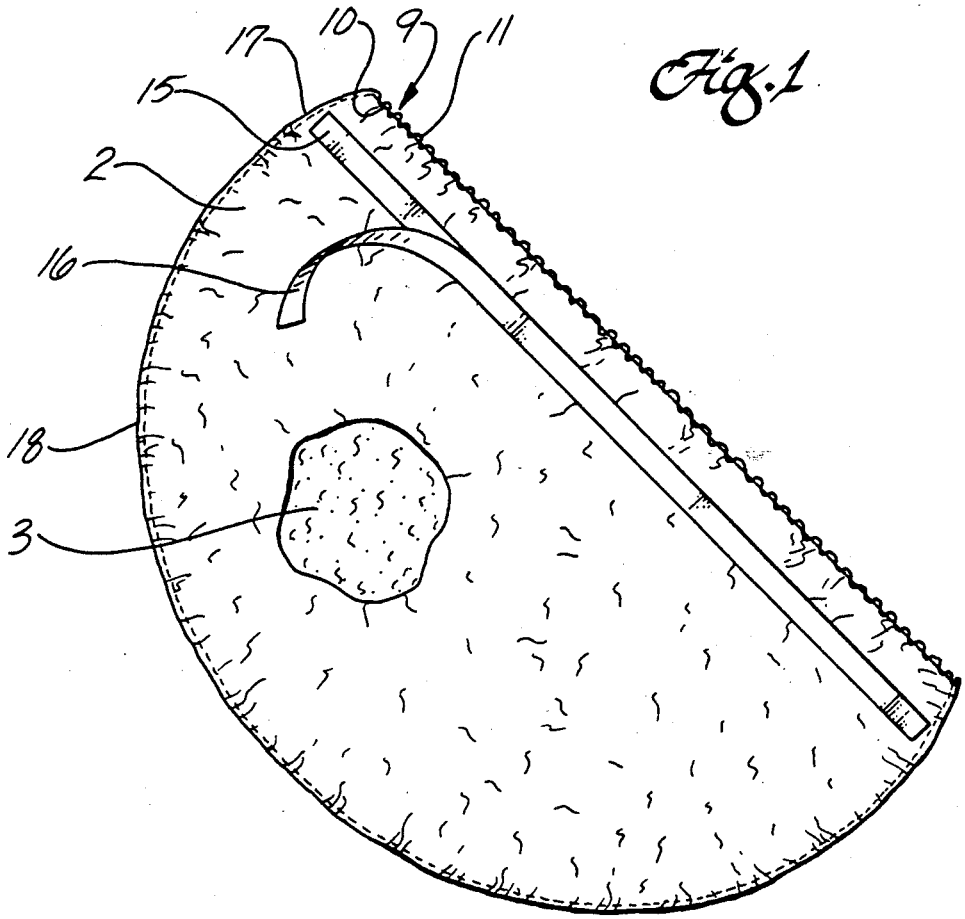
Fig. 1
Fig. 2
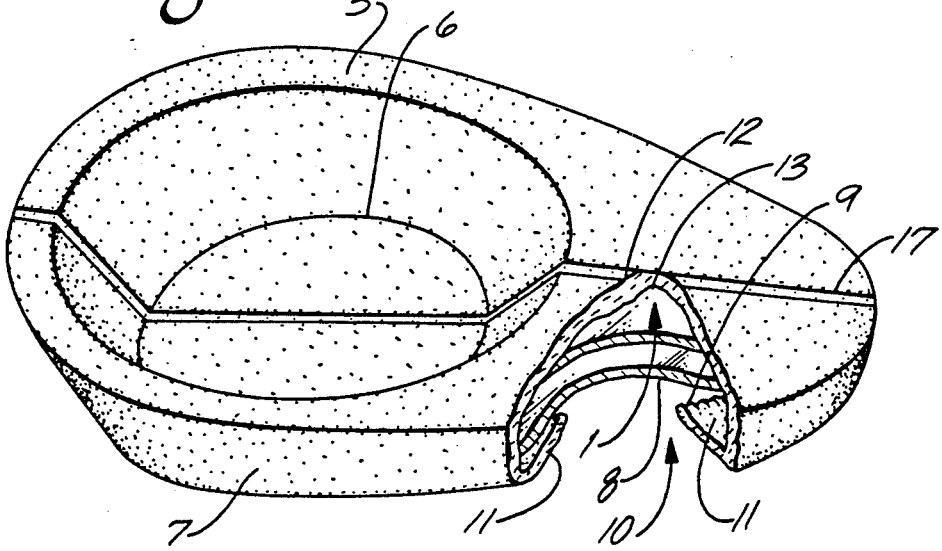

PROTECTION ARTICLE FOR DEJECTA RECEIVERS

CROSS REFERENCE TO RELATED APPLICATION

This application is a continuation in part of U.S. Pat. application Ser. No. 201,472, filed June 1, 1988, now abandoned.

FIELD OF THE INVENTION

The present invention relates generally to the field of containers or receivers for human dejecta and in particular to a protection article for such receivers.

BACKGROUND OF THE INVENTION

Bed pans, commode pots, sanitary slop pails and similar dejecta receivers require emptying and washing after each use. In the hospital and other institutional settings, sterilization is additionally necessary if they are to be safely used by different people. Such cleaning operations are time-consuming and expensive as specially trained personnel and equipment are required. There additionally exists the danger of transmission of disease or infection during the handling of receivers from the time they are used until they are emptied and sterilized.

Even in situations where the staff performing these duties are aware of the cautions to be taken, it is difficult to eliminate all contamination risks during the handling of receivers by various personnel. The shallow depth and large opening of most of receivers requires that extreme care be taken to maintain the receiver in a level position at all times.

Additional risks occur due to imperfect disinfection or sterilization. Improperly cleaned receivers may be handled by hospital staff and patients without following the careful procedures required for known contaminated receivers in the mistaken belief that no hazard exists.

The contamination risk is still greater in institutional settings outside the hospital, such as in retirement homes and infirmaries. In such locations there is often a lack of qualified staff and the special equipment necessary to keep the receivers in the required state of cleanliness.

In an attempt to meet these requirements, the prior art has suggested the use of protection articles for receivers in the form of disposable bags. However, up to the present, these bags have had certain problems and disadvantages in their use. They have been lacking from the standpoint of ease of use, economy in manufacture, and effectiveness in retaining the excreted material for preventing the spread of contamination.

There is, therefore, a need for an improved receiver protection article which may be closed tightly and watertight and possesses the ability to retain human waste materials until an attendant or other authorized person has an opportunity to dispose of the article and its contents. The article should additionally possess sufficient strength, especially wet strength, so that it may be removed from the receiver and carried to a place of disposal without rupturing. Finally, the article must meet all requirements for contact with humans and must be attractive and comfortable enough so there is no aversion to its use.

The protection article of the present invention effectively overcomes the drawbacks of the prior art disposable bags while meeting the aforementioned needs. Specifically, the article may be used as an interliner for receivers such as bedpans, providing a reduced risk of transmission of infection or disease while providing a convenience to institutional personnel, professional home attendants, and patients. The article specifically affords a very practical labor-saving expedience eliminating the need to clean and sterilize receivers.

Since the protection article can be quickly and easily closed, all noxious and unpleasant matter is confined within the article. This ability to effectively seal potentially infectious dejecta is of great significance when used with patients in hospitals or similar institutions, as it further reduces the likelihood of spreading bacterial infection and allows easier transportation of the article and receiver to a disposal area. Combined with the elimination of the requirement to sterilize the receiver, use of the article provides additional time for professional service personnel to better attend to the needs of their patents.

BRIEF SUMMARY OF THE INVENTION

Thus, in practice of this invention according to a presently preferred embodiment, the protection article for receivers comprises two sheets of paper, each waterproofed on one side. The sheets are superimposed one upon the other, waterproofed sides together, and the edges of the sheets are bonded together along a major portion of their perimeter. The portion of the sheets defined by the bonded perimeter is of a sufficient size to line the internal walls of a receiver and at least the edges of the upper surface of the receiver surrounding its opening. The unbonded portion of the perimeter of the sheets is of a size sufficient to extend over the edges surrounding the opening of the receiver.

Elasticized thread is stitched to the edges of the unbonded portion of the perimeter for fitting and securing the unbonded perimeter of the sheets over the external walls of the receiver. The elasticity of the unbonded perimeter temporarily secures the sheets against motion with respect to the receiver.

Adhesive material is affixed to at least one sheet adjacent to the unbonded portion of the perimeter of the sheet for sealing the sheets together, thereby confining and retaining the dejecta within the protection article.

BRIEF DESCRIPTION OF THE DRAWINGS

These and other features of this invention are more fully set forth in the following description of presently preferred embodiments of the invention. The description is presented with reference to the accompanying drawings in which:

FIG. 1 is a partially cut-away plan view of a preferred embodiment of dejecta cover laid flat, showing the protective backing for an adhesive strip partially peeled away;

FIG. 2 is a partially cut-away perspective view of the embodiment shown in FIG. 1 in place for use on a typical dejecta receiver;

DETAILED DESCRIPTION

Figure 3:
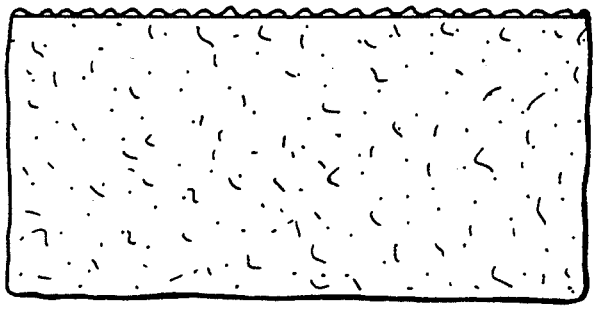
FIG. 3 is a sketch of another embodiment of dejecta receiver cover.
Figure 4:
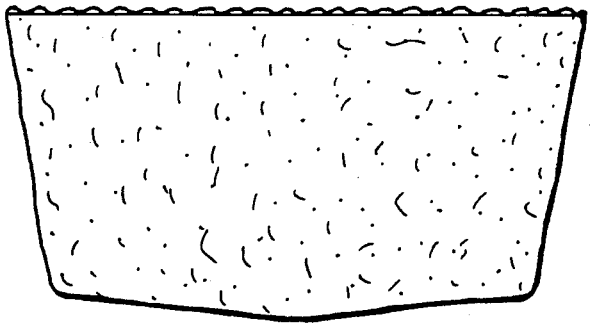
FIG. 4 is a sketch of another embodiment of dejecta receiver cover.
Figure 5:
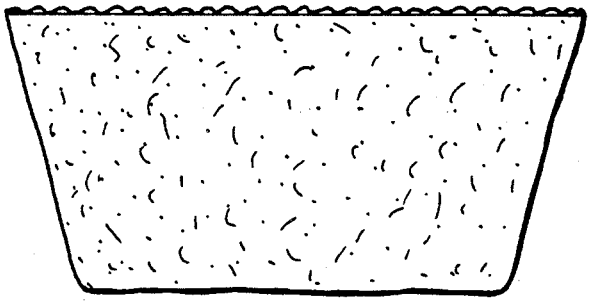
FIG. 5 is a sketch of still another embodiment of dejecta receiver protective article..

The present invention provides an improved protection article or temporary cover for dejecta receivers. In its preferred embodiment, the article may be used with bed pans, commode pots, sanitary slop pails and the like, which normally require emptying and washing after each use. In a preferred embodiment, the article is intended to be used with a bed pan 1. The article comprises at least two approximately semicircular sheets 2 and 3. The shape of the sheets 2 and 3 are not critical and may be changed to meet the requirements of the receiver on which they are placed. For example, the sheets may be rectangular as in FIG. 3, pentagonal as in FIG. 4, trapezoidal as in FIG. 5, polygonal or other shape fashionable into a removable covering which will line the internal walls of the pan as well as the edges 5 surrounding the opening 6 of the pan. It remains preferred to employ a roughly semicircular shape for the sheets as hereinabove described since the corners of polygonal shapes are not as strong as the continuous curve.

The material used for the sheets 2 and 3 must be flexible, but the specific material selected is not generally critical. There are numerous types of paper and nonwoven fabrics which may be satisfactorily employed. It is required, however, that the sheets have a certain degree of strength, including wet strength, and stability under normal conditions of use. It is additionally preferred that the sheets be subject to disposal by incineration or be made of materials that are or become biodegradable. Paper materials generally fulfill these requirements when suitably coated and are therefore preferred.

One side of each sheet 2 and 3 is laminated with a coating or layer of liquid or water impervious material. The coated sheets are considered waterproof when they retain water and substantially unimpaired wet strength for forty minutes or so, even though the waterproofing may degrade later. An exemplary waterproof coating may be formed of plastic resin, such as polyethylene, applied in accordance with conventional coating techniques. This coating should be thin enough to permit the paper to retain its flexibility while providing the necessary waterproofing. A coating thickness of from 1 to 1.5 micrometers is preferred. A thermoplastic resin is desirably used so that it may be heat sealed.

The sheets 2 and 3 are superimposed one upon another, waterproof sides together, and their edges bonded together along a major portion of their perimeter. Where the sheets are semicircular in shape, the curved portion of their edges are bonded. When the sheets are polygonal, the edges of all but one side are bonded together. The sheets are readily bonded along the edges by heat sealing the thermoplastic polyethylene, or adhesives may be used to provide the desired strength and water resistance.

Regardless of the shape of the periphery of the sheets they may be flat blanks providing the advantages of ease of manufacture with steel rule dies or the like from rolls of material, and efficient handling and storage of the finished product. Heat sealing is particularly suitable for securing the sheets together since the sheets may be cut to shape and sealed together in a single manufacturing operation.

The area confined by the bonded portion of the sheets is of a sufficient size to cover the bottom and internal walls of the pan, as well as the edges and external walls 7 of the pan. The sheets are preferably of a sufficient size to additionally cover a portion of the bottom 8 of the pan in order to better secure the covering against motion with respect to the pan.

The shape and size of the unbonded portion of the perimeter of the sheets is sufficient to extend over the upper surface of the pan and around its perimeter to fit underneath the pan. The edge 9 of the unbonded perimeter of the sheets comprises elastic means 10 which secures the article around the external surface of the pan.

Suitable elastic means include elasticized thread 10 stitched along the unbonded edge of the sheets 9. The stitching used is preferably of a type which will cause the edge 9 to pucker or crease, thereby drawing the edge tightly against an external surface of the pan. (The cover is shown with the thread stretched in FIG. 1 so that the cover lies flat instead of being puckered.)

The thread is typically attached by stitching the edge of the sheet to the elasticized thread while the latter is stretched. The paper puckers when tension on the thread is released. Alternatively, the unbonded edge 9 of each sheet may be slightly folded over on itself to form a doubled-over marginal edge which securely restrains a suitable length of elasticized material or drawstring (not shown).

After dejecta have been deposited into the receiver, the unbonded edges 9 of the cover are sealed in any convenient way, such as by means of a pressure sensitive band 15 affixed to at least one sheet on its non-waterproofed side adjacent to the unbonded edge of the sheet. The band of adhesive is preferably covered with a removable backing 16 to prevent its premature attachment to the receptacle or the other sheet.

Preferably, a band of pressure sensitive adhesive is provided along both sheets adjacent to the unbonded edge. Then, if one band of adhesive does not adhere to the opposite sheet because it is mispositioned, the other band will remain to effect a closure. Particularly strong closure is obtained when the two pressure sensitive adhesives close face to face.

The protective cover is placed over a bedpan or the like by slipping the pan inside the open edge of the cover with the elasticized opening beneath the pan. The large central area of the bag-like cover may then be pressed into the opening of the bed pan. This places the paper side of the cover adjacent to the patient using the bedpan for comfort, and to prevent sticking of the somewhat smooth waterproofed surface against the person's skin. This also places the adhesive bands underneath the pan where they are not exposed to dejecta. The elasticized thread along the open edges of the cover retain it on the bedpan.

When the protective cover contains dejecta, it is removed by pulling the elasticized edges around the pan and upwardly for retaining the dejecta within the cover. The protective strips along the adhesive bands are removed and the edges pressed together to close the dejecta safely within the waterproof cover. This may then be placed on a cart or the like for later disposal, while the bedpan is restored to service without special cleaning.

The protection articles are preferably sterilized upon manufacture and sealed in a sterilized container until use. The protection article is of the one-use type and when made of paper is biodegradable or may be incinerated. The preferred method of disposal of the article when made from paper coated with polyethylene is incineration. Biodegradable cellulosic coatings which have wet strength for forty minutes or more may also be desirable. Other equivalent, more readily biodegradable, plastics are also desirable.

In view of the foregoing description of the invention, those skilled in the relevant arts will have no difficulties in making changes and modifications in the different described elements of the invention in order to meet their specific requirements or conditions. For example, the waterproof coating of the sheets may be a biodegradable wax coating permitting the article to be easily disposed of by flushing down a normal toilet or other appropriate sanitary equipment. In an embodiment where the sheets are bonded along a straight line, a single sheet may be used and folded along the line instead of heat sealing.

More than two layers may be used, including additional layers having liquid absorbent characteristics bonded to the outside of the waterproof layers to retain dejecta which may possibly seep through the waterproof layers. The sheets of the article may be bonded together in a shape facilitating use with transportable urinals. A colored coating or dye may be placed on the non-waterproofed surface of the sheets to provide an attractive appearance. Further, the sheets may be additionally provided with an effective deodorant or sterilent to suppress noxious odors and kill diseasespreading germs. Such changes and modifications may be made without departing from the scope and spirit of the invention as set forth in the following claims.

What is claimed is:

1. A protection article for a bedpan comprising:

two flexible sheets of superimposed materials, each sheet being waterproofed on one face and bonded together along the edge of the waterproofed face defining a closed path along a major portion of the perimeter of the sheets, the portion of the sheets defined by the bonded perimeters being of a sufficient size for lining at least a portion of the bottom and internal walls of the receiver and to extend over the edges surrounding the opening of the receiver to a position under the receiver, the unbonded portion of the perimeter of the sheets defining an opening of sufficient size to readily encompass the edges surrounding the opening of the receiver; 'elastic means attached to the edges of the unbonded portion of the perimeter of the sheets for fitting over the external walls of the receiver and temporarily securing the sheets against removal from the receiver; and a band of pressure sensitive adhesive along the unbonded edge on the face other than the waterproofed face of at least one of the sheets for closing the bedpan cover.

2. The protection article of claim 1 wherein the sheets are substantially rectangular in shape and are bonded together along three of the four sides of their perimeter.

3. The protection article of claim 1 wherein the sheets are substantially pentagonal in shape and are bonded together along four of the five sides of their perimeter.

4. The protection article of claim 1 wherein the sheets are flat sheets of material.

5. The bedpan cover of claim 1 wherein the sheets are each polygonal and are bonded together along all the edges except one.

6. The bedpan cover of claim 1 wherein the sheets are each approximately semicircular, are bonded together along the curved edges and are unbonded along the straight edge.

7. The bedpan cover of claim 1 wherein the sheets are each paper having a layer of polyethylene on the abutting faces ,the polyethylene being heat sealed around the bonded edges of the cover.

8. The bedpan cover of claim 7 wherein the band of pressure sensitive adhesive is on the face of the sheet opposite to the face with polyethylene.

9. The protection article of claim 1 wherein the sheets are made of a biodegradable material.

10. The protection article of claim 1 wherein the sheets are made of paper.

11. The protection article of claim 10 wherein the waterproofing comprises polyethylene laminated onto the sheets.

* * * * *